United States Patent [19]

Emanuelsson et al.

[11] 4,144,122

[45] Mar. 13, 1979

[54] QUATERNARY AMMONIUM COMPOUNDS AND TREATMENT OF CELLULOSE PULP AND PAPER THEREWITH

[75] Inventors: Jan G. Emanuelsson; Svante L. Wahlen, both of Stenungsund, Sweden

[73] Assignee: Berol Kemi AB, Stenungsund, Sweden

[21] Appl. No.: 855,587

[22] Filed: Nov. 29, 1977

Related U.S. Application Data

[63] Continuation-in-part of Ser. No. 734,798, Oct. 22, 1976, abandoned, and a continuation-in-part of Ser. No. 515,738, Oct. 17, 1974, abandoned, which is a continuation of Ser. No. 306,250, Nov. 10, 1972, abandoned.

[51] Int. Cl.[2] ..... D21D 3/00

[52] U.S. Cl. ..... 162/158; 162/183; 162/186; 162/201

[58] Field of Search ..... 162/158, 161, 100, 201, 162/183, 186; 260/567.6 M; 252/357; 427/394, 395; 428/537

[56] References Cited

U.S. PATENT DOCUMENTS

| | | | |
|---|---|---|---|
| 2,756,647 | 7/1956 | Thompson | 162/161 |
| 3,554,862 | 1/1971 | Hervey et al. | 162/158 |
| 3,556,931 | 1/1971 | Champaigne | 162/158 |
| 3,636,114 | 1/1972 | Tobler et al. | 260/567.6 M |
| 3,932,495 | 1/1976 | Martinsson et al. | 260/567.6 M |
| 3,972,855 | 8/1976 | Martinsson et al. | 260/567.6 M |

FOREIGN PATENT DOCUMENTS

| | | | |
|---|---|---|---|
| 2256239 | 5/1973 | Fed. Rep. of Germany | 162/158 |

*Primary Examiner*—S. Leon Bashore
*Assistant Examiner*—Peter Chin

[57] ABSTRACT

Quaternary ammonium compounds are provided which are useful in the treatment of cellulose pulp and paper to reduce inter-fiber bonding and thereby obtain a low mechanical strength.

A process is also provided for the treatment of cellulose pulp or paper therewith to reduce inter-fiber bonding and mechanical strength.

13 Claims, No Drawings

QUATERNARY AMMONIUM COMPOUNDS AND TREATMENT OF CELLULOSE PULP AND PAPER THEREWITH

This application is a continuation-in-part of Ser. No. 734,798, filed Oct. 22, 1976, which in turn is a continuation-in-part of Ser. No. 515,738, filed Oct. 17, 1974, which in turn is a continuation of Ser. No. 306,250, filed Nov. 10, 1972, and all three now abandoned.

U.S. Pat. No. 3,395,708 and Reissue No. 26,939 to Hervey and George, dated Aug. 6, 1968 and Aug. 18, 1970, and French Pat. No. 1,265,818, disclose that treatment of unfiberized wet cellulose pulp with a surfactant before or during the formation of the cellulose pulp on a drying machine or a paper machine reduces the number of inter-fiber bonds of the cellulose. The improvement is accomplished by impregnating a wet slurry of wood pulp with a cationic debonding agent, forming the wet slurry into a wet pressed wood pulp sheet. The result of this treatment is a cellulose sheet or paper having a low degree of mechanical strength. Among the surfactants said to be useful in this way are long chain cationic surfactants, preferably with at least twelve carbon atoms in at least one alkyl chain, and illustrative, but non-limiting, specific examples of same are fatty dialkyl amine quaternary salts, mono fatty alkyl tertiary amine salts, primary amine salts, and unsaturated fatty alkyl amine salts.

The hydrophilic cationic portion of the surfactant is considered to be attracted to the negatively-charged cellulose fibers, while the hydrophobic portions of the molecule are exposed on the surface, thus rendering the surface of the fibers hydrophobic. The number of inter-fiber bonds between the cellulose fibers is reduced, and the defibration into cellulose fluff is thereby facilitated. However, a highly hydrophilic cellulose pulp when treated with such cationic surfactants will exhibit more hydrophobic properties than the corresponding untreated cellulose pulp. If the cellulose pulp or paper is intended to be used in the production of highly absorbent products, such as sanitary products, hydrophobicity is not desirable, since it reduces absorptivity. Consequently, in the treatment of such cellulose derivatives, it has been necessary in order to improve the wettability of the cellulose fibers after the treatment to add a wetting agent, which is preferably added to the cellulose pulp sheet in a separate operation, owing to the low degree of affinity to cellulose of these wetting agents.

In accordance with the invention it has been determined that bis(alkoxy-(2-hydroxy)propylene) quaternary ammonium compounds which contain both cationic and nonionic hydrophilic groups when used to treat cellulose pulp or paper reduce inter-fiber bonding and therefore impart a low mechanical strength, while at the same time preserving good hydrophilic properties.

The quaternary ammonium compounds in accordance with the invention have the general formula:

cation anion

-continued

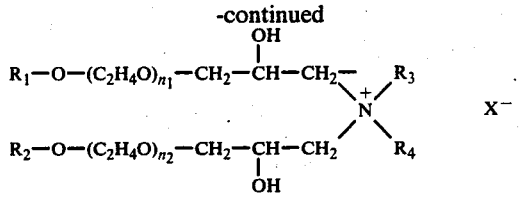

In this formula:

$R_1$ and $R_2$ are aliphatic hydrocarbon groups, which can be either saturated or unsaturated, having from about eight to about twenty-two carbon atoms.

$R_3$ and $R_4$ are methyl, ethyl and hydroxyethyl.

$n_1$ and $n_2$ are numbers within the range from 2 to about 10, representing the number of oxyethylene groups present in each substituent, and usually represent average values, and therefore need not be integers.

X is a salt-forming anion, and can be organic or inorganic.

The quaternary ammonium compounds in accordance with the invention by reducing inter-fiber bonding provide by the treatment cellulose pulp or paper with good hydrophilicity (wettability) and low mechanical strength. Generally, it can be said that as the number $n_1$ and $n_2$ of oxyethylene units increases from two to ten, the hydrophilicity (wettability) of the cellulose pulp or paper increases, while the number of inter-fiber bonds between cellulose chains is somewhat reduced. As the number of carbon atoms in the substituents $R_1$ and $R_2$ increases, the hydrophilicity (wettability) decreases, and the effect on the number of inter-fiber bonds between cellulose chains is increased. Thus, by appropriately adjusting the number of carbon atoms in $R_1$ and $R_2$ and the number $n_1$ and $n_2$ of oxyethylene units, it is possible to obtain any desired combination of hydrophilicity (wettability) and effect on the inter-fiber bonds between cellulose chains, as required for the particular use. An optimum balance in wettability and in effect on inter-fiber bonds is obtained when $R_1$ and $R_2$ have from about fourteen to about twenty carbon atoms; $R_3$ and $R_4$ are methyl or ethyl groups; and $n_1$ and $n_2$ are numbers within the range from 2 to about 6.

The quaternary ammonium compounds in accordance with the invention should be added to the wet cellulose pulp after delignification or bleaching, either before or during the formation into sheets or continuous webs on the cellulose pulp machine or a paper machine. The compounds are preferably in an aqueous solution in a concentration within the range from about 1% to about 15% by weight of the quaternary ammonium compound. The treating solutions may also include viscosity-reducing additives, such as ethanol and the monoethyl ether of diethylene glycol, as well as nonionic surfactants, such as adducts of ethylene oxide or propylene oxide with aliphatic alcohols alkyl phenols, which are normally added in order to improve the wettability of the cellulose pulp or paper.

The amount of such compounds is based on the dry weight of the cellulose, and is in accordance with the desired effect. Normally, the amount added to the cellulose is within the range from about 0.1% to about 2%, preferably 0.2% to 1%.

The treating solution can be applied by spraying or dipping, or by kissing rolls, or any other suitable technique. Following application, the treated cellulose pulp or paper can be dried in the usual way.

The treated cellulose may be defibrated into cellulose fluff, and in this form it may be used in various hygienic products, such as diapers, absorbent pads, sanitary pads, tampons and the like.

The alkoxyethylene oxy(2-hydroxy)propylene quaternary ammonium compounds in accordance with the invention can be prepared by reaction of from two to about ten mols of ethylene oxide with one mol of an aliphatic alcohol having from about eight to about twenty-two carbon atoms. The reaction of ethylene oxide with the alcohol is carried out in the presence of an alkali catalyst, preferably sodium hydroxide, at an elevated temperature. If no oxyethylene unit is present, of course this reaction step is omitted. The resulting alkoxy glycol ether is reacted with epichlorohydrin, producing the corresponding chloroglyceryl or chlorohydroxypropylene ether, which is then reacted with a secondary amine having the formula $R_3R_4NH$, where $R_3$ and $R_4$ are methyl, ethyl, or hydroxyethyl. The product is a quaternary ammonium compound of the invention, in the form of its chloride salt. The chloride ion can then be exchanged by another anion, using known techniques, for example, by addition of a sodium salt with a higher solubility constant than sodium chloride, or by ion exchange in an anion exchanger. Among anions other than chloride ion which can serve as X in the quaternary ammonium compounds of the invention are nitrate, carbonate, hydroxyl, phosphite, iodide, bromide, methyl, sulfate, acetate, carbonate, formate, propionate, citrate and tartrate. The monovalent anions are preferred.

The reaction between the ethylene oxide adduct and the epichlorhydrin proceeds at an elevated temperature within the range from about 100° to about 150° C. in the presence of a catalyst, such as stannic chloride, boron trifluoride, and perchloric acid, $HClO_4$. These give a rapid, easily controllable reaction, but other acid catalysts such as toluene sulfonic acid and sulfuric acid can also be used.

In order to ensure complete reaction of the ethylene oxide adduct, an excess of epichlorhydrin is generally added.

The quaternization of the secondary amine with the chloroglyceryl ether is carried out in the presence of alkali, generally sodium hydroxide, at an elevated temperature within the range from about 100° to about 150° C. The reaction is carried out in the presence of an organic solvent with a boiling point of at least 60° C. Suitable organic solvents include methanol, ethanol, and the monoethylether of diethylene glycol.

It is also possible to react the chloroglyceryl ether with ammonia or with a primary amine having a methyl, ethyl, or hydroxyethyl group, and the resulting product may then be quaternized with methyl or ethyl chloride or dimethyl or diethyl sulfate. However, this procedure is more complicated than the previously described procedure, and it involves more reaction steps, and results in larger amounts of byproducts and lower total yields of the desired quaternary ammonium compounds.

The aliphatic alcohols having from about eight to about twenty-two carbon atoms which can be used in the reaction products of the invention include both saturated and unsaturated alcohols, such as octyl alcohol, decyl alcohol, lauryl alcohol, myristyl alcohol, cetyl alcohol, stearyl alcohol, eicosyl alcohol, oleyl alcohol, ricinoleyl alcohol, linoleyl alcohol, and eicosenyl alcohol. The alcohol can also be a mixture of such alcohols, such as are obtained form natural fats and oils by reduction of the fatty acid or fatty acid ester mixtures obtained from such oils, such as coconut oil fatty alcohols, palm oil fatty alcohols, soya oil fatty alcohols, linseed oil fatty alcohols, corn oil fatty alcohols, castor oil fatty alcohols, fish oil fatty alcohols, whale oil fatty alcohols, tallow fatty alcohols, and lard fatty alcohols. Mixtures of synthetic alcohols prepared by the Ziegler procedure or the Oxo process can also be used. Most alcohols manufactured by the Oxo process have a branched chain, which makes possible a large number of isomers. The physical properties of these alcohol mixtures are very similar to those of the straight-chain primary alcohols.

Secondary amines which can be used in accordance with the invention include dimethyl amine, diethyl amine, diethanol amine, methyl amine, and methyl hydroxyethyl amine. Primary amines which can be used include methyl amine, ethyl amine, and hydroxyethyl amine.

The following Examples in the opinion of the inventors represent preferred embodiments of their invention.

PREPARATION OF ADDITIVES

Additive A

In a reaction vessel provided with a heating coil, a stirrer, and a reflux condenser for cooling were placed 2 mols of tallow fatty alcohol mixture having from sixteen to twenty carbon atoms in the alkyl chain. 12 mols of ethylene oxide were then added, and reacted with the alcohol mixture in the presence of 3 grams of sodium hydroxide as a catalyst. There was then added 2.2 mols of epichlorhydrin and 6 grams of stannic chloride $SnCl_4$, and the resulting mixture was heated at about 125° C. for 2½ hours in order to bring about reaction between the ethylene oxide adduct and the epichlorhydrin. Unreacted epichlorhydrin was removed under vacuum; the product was a pale yellow viscous liquid.

In an autoclave fitted with a heater and a stirrer was placed 1.8 mols of this reaction product together with 250 grams of ethanol containing dissolved therein 0.9 mol of dimethyl amine, and an aqueous solution of 50 grams sodium hydroxide in 30 grams of water. The reaction mixture was held in the autoclave for three hours at 125° C., and then the excess dimethyl amine was removed by bubbling nitrogen gas through the reaction mixture. The reaction product was a pale beige material containing 89% quaternary amine and 7% tertiary amine, calculated on the theoretical content of amine. The quaternary ammonium compound had the formula:

$$[\text{Tallow-}(O\text{-}CH_2CH_2)_6\text{-}OCH_2CH(OH)CH_2]_2N(CH_3)_2Cl$$

Additive B

Using the above procedure, 2 mols of tallow fatty alcohols, 4 mols of ethylene oxide, 2 mols of epichlorhydrin, and 1 mol of dimethyl amine were reacted to form the product:

$$[\text{Tallow-}(OCH_2CH_2)_2\text{-}OCH_2CH(OH)CH_2]_2N(CH_3)_2Cl$$

Additive C

Using the above procedure, 2 mols of lauryl alcohol 8 mols of ethylene oxide, 2 mols of epichlorhydrin, and 1 mol of dimethyl amine were reacted to form the product:

$$[C_{12}H_{25}\text{-}(OCH_2CH_2)_4\text{-}OCH_2CH(OH)CH_2]_2N(CH_3)_2Cl$$

Additive D

Using the above procedure, 2 mols of eicosyl alcohol, 20 mols of ethylene oxide, 2 mols of epichlorhydrin, and 1 mol of dimethyl amine were reacted to form the product:

$$[\text{Eicosyl-}(O\text{-}CH_2CH_2)_{10}OCH_2CH(OH)CH_2]_2N(CH_3)_2Cl$$

Additive E

Using the above procedure, 2 mols of octadecyl alcohol, 8 mols of ethylene oxide, 2 mols of epichlorhydrin, and 1 mol of methyl hydroxyethyl amine were reacted to form the product:

$$[C_{18}H_{37}-(O-CH_2CH_2)_4\,OCH_2CH(OH)CH_2]_2\,\underset{\underset{CH_2CH_2OH}{|}}{N}CH_3-Cl$$

Additive F

In this part, dioctadecyl dimethyl ammonium chloride was used, a commercially used additive, Arquat 2HT75, falling under U.S. Pat. No. 3,396,708, and used in the manufacture of cellulose fluff.

Additive G

Using the above reaction procedure, a reaction product of the invention without oxyethylene groups was prepared of 2 mols octyl alcohol, 2 mols epichlorhydrin, and 1 mol dimethyl amine, having the formula:

$$[C_8H_{17}-O-CH_2CH(OH)CH_2]_2-\overset{\overset{CH_3}{|}}{\underset{\underset{CH_3}{|}}{N}}Cl$$

EXAMPLES 1 TO 5

Each of the above additives A to G, inclusive, was then used individually in the treatment of aqueous bleached pine sulfate cellulose pulp in the form of an aqueous slurry with a pulp consistency of 2%. The compound was added in the amount of 0.5%. Hand sheets were formed from the pulp in the usual way. After drying, as an evaluation of the debonding effect, mechanical strength of these hand sheets was determined as burst factor according to SCAN P-24:68, and hydrophilicity was evaluated in terms of water absorption according to Klemm, SCAN P-13:64. The results are shown in Table I, in comparison with a control to which no additive was added:

TABLE I

| Example No. | Additive | Debonding Effect Burst Factor | Hydrophilicity Klemm Water Absorption (mm after 10 minutes) |
|---|---|---|---|
| Control A | No additive | 18.0 | 105 |
| 1 | A | 7.8 | 98 |
| 2 | B | 6.7 | 65 |
| 3 | C | 9.9 | 95 |
| 4 | D | 8.4 | 89 |
| 5 | E | 9.1 | 82 |
| Control B | F | 7.0 | 45 |
| Control C | G | 8.0 | 73 |

From these results, it is evident that with the additives according to the invention, A to E, the cellulose pulp retains considerably better water absorption at a low burst factor than when the closely related compounds F and G are used, while the mechanical strength is greatly reduced, compared to the Control A with no additive. As compared to compound F, it is unexpectedly found that compound B allows the cellulose pulp to retain a significantly better water absorption, and a lower burst factor. This makes it clear that the compounds according to the invention are superior fiber debonding agents, as compared to those of similar structure earlier used.

EXAMPLES 6 TO 7

Sheets of bleached pine sulfate cellulose pulp with a surface weight of 800 grams per square meter were manufactured on a paper machine. In the machine chest, before the sheeting off, 0.15 and 0.5 weight percent, respectively, calculated on the dry weight of the cellulose, of one of the products A, B and F above, was added. The pulps were then dried, and dry-defibrated into cellulose fluff in a dry-defibering machine with a spiked roller. As an evaluation of the debonding effect, the consumption of energy in kilowatt hours per ton of pulp was determined in relation to that required for pulp without an additive taken as 100%. The lower the energy requirement, the greater the debonding. As an evaluation of hydrophilicity (wettability), the time required to thoroughly wet a portion of the pulp sheet 4 × 4 centimeters in surface area when floated on water was determined, as compared to pulp without an additive. The results are indicated in Table II:

TABLE II

| Example No. | Product | Amount of Additive | Debonding Effect Relative Consumption of Energy (%) | Hydrophilicity Wetting Time (Seconds) |
|---|---|---|---|---|
| Control D | No additive | — | 100 | 2.0 |
| 6a | A | 0.15 | 57 | 3.3 |
| 6b | A | 0.5 | 35 | 3.3 |
| 7a | B | 0.15 | 57 | 2.2 |
| 7b | B | 0.5 | 32 | 6.6 |
| Control E | F | 0.15 | 62 | 7.5 |
| Control F | F | 0.5 | 32 | 25.0 |

From the results with respect to energy consumption, it is apparent that the A, B or F give equivalent debonding effects. On the other hand, the water absorptivity is greatly diminished by compound F. Compounds A and B according to the invention retain good hydrophilicity as shown by the considerably shortened wetting time, compared to F.

EXAMPLES 8 TO 10

An evaluation was made of quaternary ammonium compounds of the invention against a quaternary ammonium compound of the prior arts, as debonding agents for cellulose paper-making pulp.

Five compounds were compared, as follows:

| Example No. | Formula of page 2 | QUATERNARY AMMONIUM COMPOUND |
|---|---|---|
| Control G | | Arquad 2HT75, dioctadecyl dimethyl ammonium chloride. |
| Control H | $n_1,n_2 = 0$ | $[C_{16-18}\text{-alkyl-OCH}_2\text{—CH(OH)CH}_2]\text{—N}^+(CH_3)_2\ Cl^-$ |
| 8 | $n_1,n_2 = 2$ | $[C_{16-18}\text{-alkyl-(OC}_2H_4)_2\text{OCH}_2\text{CH(OH)CH}_2]_2\text{—N}^+(CH_3)_2\ Cl^-$ |
| 9 | $n_1,n_2 = 4$ | $[C_{16-18}\text{-alkyl-(OC}_2H_4)_4\text{OCH}_2\text{—CH(OH)—CH}_2]_4\ N^+(CH_3)_2\ Cl^-$ |
| 10 | $n_1,n_2 = 6$ | $[C_{16-18}\text{-alkyl-(OC}_2H_4)_6\text{OCH}_2\text{—CH(OH)—CH}_2]_6\ N^+(CH_3)_2\ Cl^-$ |

An addition of 0.4% by weight of the cellulose pulp of the test compounds was added to the cellulose pulp, and the paper sheet was formed by hand in a laboratory papermaking machine. As an evaluation of the effect on fiber-to-fiber bonding, the burst factor test was used, determined by the SCAN test procedure (SCAN-P24:68), to measure the bursting strength. The bursting strength is equivalent to mechanical strength, and is reduced in proportion to the debonding effect. Since the objective is to reduce fiber-to-fiber bonding without diminishing hydrophilicity, (i.e. water absorption), water absorptivity was determined using two tests, the Klemm method (SCAN-P13:64) and a laboratory test for water absorption, determined directly on the cellulose pulp as fiber fluff.

Cellulose fluff fibers (5 g) were placed in a funnel supported on a glass filter disc, and water fed from beneath through the filter, until 20 ml water had been absorbed. The time required was noted in seconds, and divided into 1000:

$$\frac{1000}{\text{time (seconds)}} = \text{Hydrophilicity factor}$$

The results obtained were as follows:

| Example No. | Quaternary Ammonium Compound | Burst Factor (measure of the debonding effect)(%) | Hydrophilicity Klemm % | Hydrophilicity Hydrophilicity Factor |
|---|---|---|---|---|
| Control J | No additive | 100 | 100 | 131 |
| Control G | Arquad 2HT75 | 50 | 40 | 40 |
| Control H | $n_1,n_2 = 0$ | 50 | 56 | 60 |
| 8 | $n_1,n_2 = 2$ | 50 | 66 | 81 |
| 9 | $n_1,n_2 = 4$ | 50 | 80 | 100 |
| 10 | $n_1,n_2 = 6$ | 50 | 84 | 106 |

The quaternary ammonium compounds of the invention, Examples 8 to 10, give an approximately equal debonding effect (as measured by burst factor) in paper, but the quaternary ammonium compounds of the invention are clearly less detrimental to hydrophilicity than the Controls comparison with Control H shows the significance of the oxyethylene groups to hydrophilicity.

It is apparent from the above results on hydrophilicity for Controls G and H that the Arquad and the compound without oxyethylene groups are unsuitable additives for pulp, as the pulps treated with them have poor water absorption properties. The compounds of the invention are much superior, and the properties improve as the number of ethylene oxide units increase. The compound containing six ethylene oxide units per molecule gives a good burst factor, and the water absorption is most nearly normal.

Having regard to the foregoing disclosure, the following is claimed as the inventive and patentable embodiments thereof:

1. A process for treating cellulose pulp fibers to reduce inter-fiber bonding and impart a low degree of mechanical strength to webs formed therefrom, while at the same time preserving good hydrophilic properties, which comprises adding to a cellulose pulp fiber slurry prior to or during formation of the slurry into a web, a quaternary ammonium compound having the general formula:

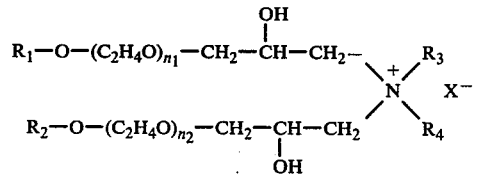

wherein:

$R_1$ and $R_2$ are aliphatic hydrocarbon groups having from about eight to about twenty-two carbon atoms;

$R_3$ and $R_4$ are selected from the group consisting of methyl, ethyl and hydroxyethyl;

$n_1$ and $n_2$ are numbers within the range from about 2 to about 10; and

X is a salt-forming anion; forming and drying said web having a low degree of mechanical strength and good hydrophilic properties.

2. A process according to claim 1, in which $R_1$ and $R_2$ have from about eight to about twenty-two carbon atoms, and $n_1$ and $n_2$ are numbers within the range from 2 to about 6.

3. A process according to claim 1 in which the quaternary ammonium compound is in an aqueous solution in a concentration within the range from about 1% to about 15% by weight.

4. A process according to claim 3, in which the aqueous solution includes a viscosity-reducing additive.

5. A process according to claim 4, in which the additive is ethanol or monoethyl ether of diethylene glycol.

6. A process according to claim 3, in which the aqueous solution includes a nonionic surfactant to improve the wettability of the cellulose pulp or paper.

7. A process according to claim 1, in which the amount of quaternary ammonium compound applied to the fibers is within the range from about 0.1% to about 2%, based on the dry weight of the cellulose.

8. A process according to claim 1, in which the quaternary ammonium compound is added by spraying a solution thereof onto the web and drying said web.

9. A process according to claim 1, in which the quaternary ammonium compound is added by impregnation of the web with a solution thereof and drying said web.

10. A process according to claim 1, in which the quaternary ammonium compound is added to the slurry of cellulose pulp fibers, which is then sheeted off and dried.

11. A process according to claim 1, in which the the web is defibrated into cellulose fluff.

12. A process according to claim 1, in which the quaternary ammonium compound is added to cellulose pulp fiber slurry, which is then formed into a paper sheet.

13. A process according to claim 1, in which the quaternary ammonium compound is added during formation of the cellulose pulp fiber slurry into a web.

* * * * *

UNITED STATES PATENT AND TRADEMARK OFFICE

CERTIFICATE OF CORRECTION

PATENT NO. : 4, 144, 122

DATED : March 13, 1979

INVENTOR(S) : Jan G. Emanuelsson et al.

It is certified that error appears in the above–identified patent and that said Letters Patent are hereby corrected as shown below:

Column 1, 66 : " cation anion "

2

-continued

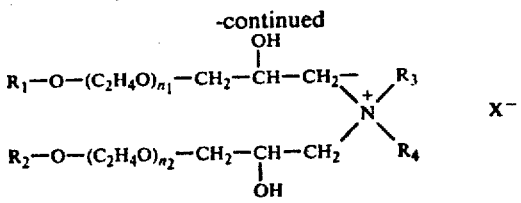

should be

2 cation anion

--

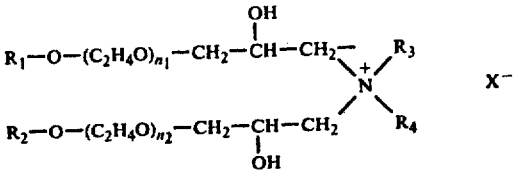

--

UNITED STATES PATENT AND TRADEMARK OFFICE

CERTIFICATE OF CORRECTION

PATENT NO. : 4,144,122

DATED : March 13, 1979

INVENTOR(S) : Jan G. Emanuelsson et al

It is certified that error appears in the above–identified patent and that said Letters Patent are hereby corrected as shown below:

Column 4, lines 56-57 : " $[Tallow\text{-}(O\text{-}CH_2CH_2)_6\text{-}OCH_2CH(OH)CH_2]_2N(CH_3)_2Cl$ "

should be

-- $[Tallow\text{-}(O\text{-}CH_2CH_2)_6\text{-}OCH_2CH(OH)CH_2]_2N(CH_3)_2Cl$ --

Column 4, lines 66-67 : " $[Tallow\text{-}(OCH_2CH_2)_2\text{-}OCH_2CH(OH)CH_2]_2N(CH_3)_2Cl$ "

should be

-- $[Tallow\text{-}(OCH_2CH_2)_2\text{-}OCH_2CH(OH)CH_2]_2N(CH_3)_2Cl$

Column 5, lines 8-9 : " $[C_{12}H_{25}\text{-}(OCH_2CH_2)_4\text{-}OCH_2CH(OH)CH_2]_2N(CH_3)_2Cl$ "

should be

-- $[C_{12}H_{25}\text{-}(OCH_2CH_2)_4\text{-}OCH_2CH(OH)CH_2]_2N(CH_3)_2Cl$ --

UNITED STATES PATENT AND TRADEMARK OFFICE

CERTIFICATE OF CORRECTION

PATENT NO. : 4, 144, 122

DATED : March 13, 1979

INVENTOR(S) : Jan G. Emanuelsson et al

It is certified that error appears in the above-identified patent and that said Letters Patent are hereby corrected as shown below:

Column 5, lines 19-20 : " $[Eicosyl\text{-}(O\text{-}CH_2CH_2)_{10}OCH_2CH(OH)CH_2]_2N(CH_3)_2Cl$ "

should be

-- $[Eicosyl\text{-}(O\text{-}CH_2CH_2)_{10}OCH_2CH(OH)CH_2]_2N(CH_3)_2Cl$ --

Column 10, line 12 : Please delete "the" second occurrence.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*